US005297867A

United States Patent [19]

Holman

[11] Patent Number: 5,297,867

[45] Date of Patent: Mar. 29, 1994

[54] MIXER APPARATUS

[76] Inventor: Lanny D. Holman, 340 Linden, Excelsior Springs, Mo. 64024

[21] Appl. No.: 27,421

[22] Filed: Mar. 8, 1993

[51] Int. Cl.[5] ..... B01F 7/02

[52] U.S. Cl. ..... 366/349; 366/325; 366/279; 416/142

[58] Field of Search ..... 366/279, 325, 330, 349, 366/348, 292, 297, 343, 342, 331, 326; 416/231 A, 142; 215/DIG. 8

[56] References Cited

U.S. PATENT DOCUMENTS

| | | | |
|---|---|---|---|
| 124,176 | 2/1872 | Twining | 366/279 |
| 588,286 | 8/1897 | Ofer | 366/279 |
| 690,254 | 12/1901 | Enzler | 366/279 |
| 742,168 | 10/1903 | Constine | 366/325 |
| 832,429 | 10/1906 | Stacey | 366/325 |
| 3,455,540 | 7/1969 | Marcmann | 416/142 |
| 3,559,962 | 2/1971 | Enssle | 416/142 |
| 4,083,653 | 4/1978 | Stiffler | 416/142 |
| 4,848,919 | 7/1989 | Lipp et al. | 366/325 |

FOREIGN PATENT DOCUMENTS

| | | | |
|---|---|---|---|
| 1068737 | 6/1954 | France | 366/279 |
| 24549 | 6/1902 | Switzerland | 366/279 |

*Primary Examiner*—Harvey C. Hornsby
*Assistant Examiner*—Patrick F. Brinson
*Attorney, Agent, or Firm*—Leon Gilden

[57] ABSTRACT

A mixer apparatus includes a container having a first shaft diametrically directed through the container, with the first shaft including first and second blades mounted to the shaft oriented parallel to the shaft, with third and fourth shafts mounted coaxially aligned relative to opposed ends of the first shaft, with the third and fourth shafts including respective right and left hand threads directed into the container to project fluid from the threads back into the container preventing such fluids from expressing exteriorly of the container during mixing.

2 Claims, 4 Drawing Sheets

MIXER APPARATUS

BACKGROUND OF THE INVENTION

1. Field of the Invention

The field of invention relates to mixing apparatus, and more particularly pertains to a new and improved mixer apparatus wherein the same includes a plurality of blades mounted to a central shaft, wherein the central shaft includes opposed thread portions to redirect fluid into the container from a mixing procedure.

2. Description of the Prior Art

Mixing apparatus of various types have been utilized throughout the prior art and exemplified in the U.S. Pat. Nos. 5,074,125; 4,826,324; 3,880,407; 5,052,892; and 4,187,028.

The instant invention attempts to overcome deficiencies of the prior art by providing for thread structure to direct fluids onto the container during a mixing procedure preventing such fluids from expressing themselves exteriorly of the container and in this respect, the present invention substantially fulfills this need.

SUMMARY OF THE INVENTION

In view of the foregoing disadvantages inherent in the known types of mixing apparatus now present in the prior art, the present invention provides a mixer apparatus including a shaft having blades thereon, wherein the shaft includes extension shafts that in turn include opposed pitched thread to direct fluid into the container during a mixing procedure. As such, the general purpose of the present invention, which will be described subsequently in greater detail, is to provide a new and improved mixer apparatus which has all the advantages of the prior art mixing apparatus and none of the disadvantages.

To attain this, the present invention provides a mixer apparatus including a container having a first shaft diametrically directed through the container, with the first shaft including first and second blades mounted to the shaft oriented parallel to the shaft, with the third and fourth shafts mounted coaxially aligned relative to opposed ends of the first shaft, with the third and fourth shafts including respective right and left hand threads directed into the container to project fluid from the threads back into the container preventing such fluids from expressing exteriorly of the container during mixing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mixer apparatus which has all the advantages of the prior art mixing apparatus and none of the disadvantages.

It is another object of the present invention to provide a new and improved mixer apparatus which may be easily and efficiently manufactured and marketed.

It is a further object of the present invention to provide a new and improved mixer apparatus which is of a durable and reliable construction.

An even further object of the present invention is to provide a new and improved mixer apparatus which is susceptible of a low cost of manufacture with regard to both materials and labor, and which accordingly is then susceptible of low prices of sale to the consuming public, thereby making such mixer apparatus economically available to the buying public.

Still yet another object of the present invention is to provide a new and improved mixer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
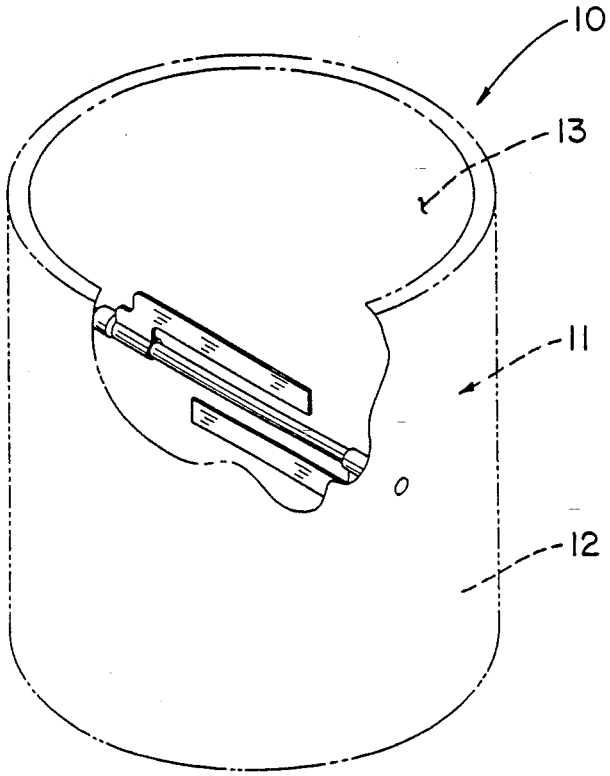
FIG. 1 is an isometric illustration of the invention.

With reference now to the drawings, and in particular to FIGS. 1 to 7 thereof, a new and improved mixer apparatus embodying the principles and concepts of the present invention and generally designated by the reference numeral 10 will be described.

Figure 2:
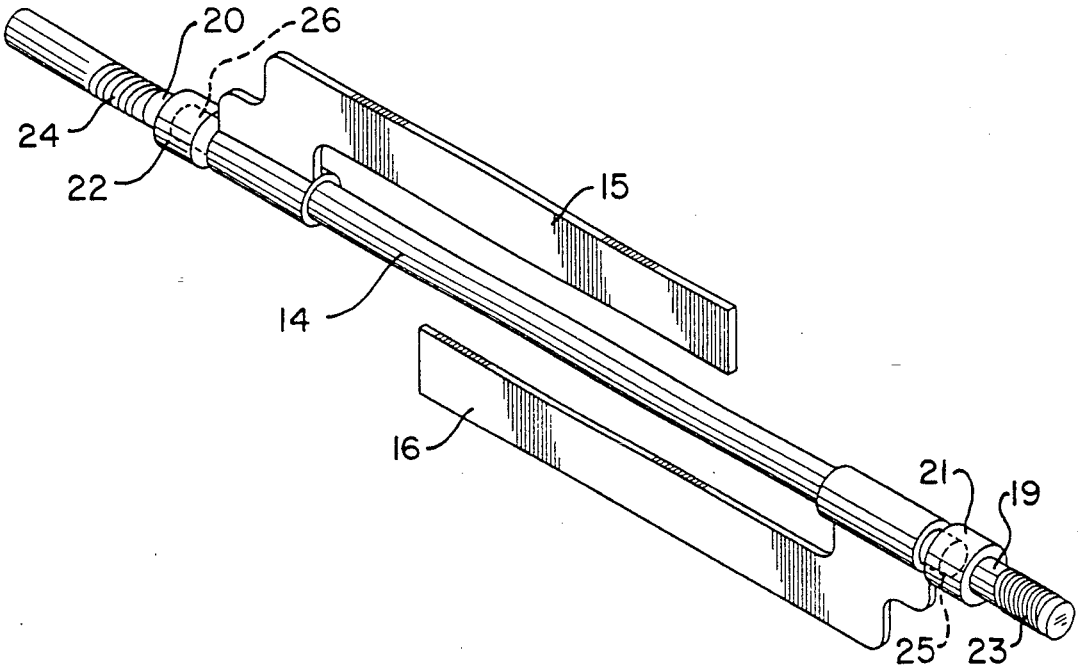
FIG. 2 is an isometric illustration of the blade structure in association with the shaft structure of the invention.
Figure 3:
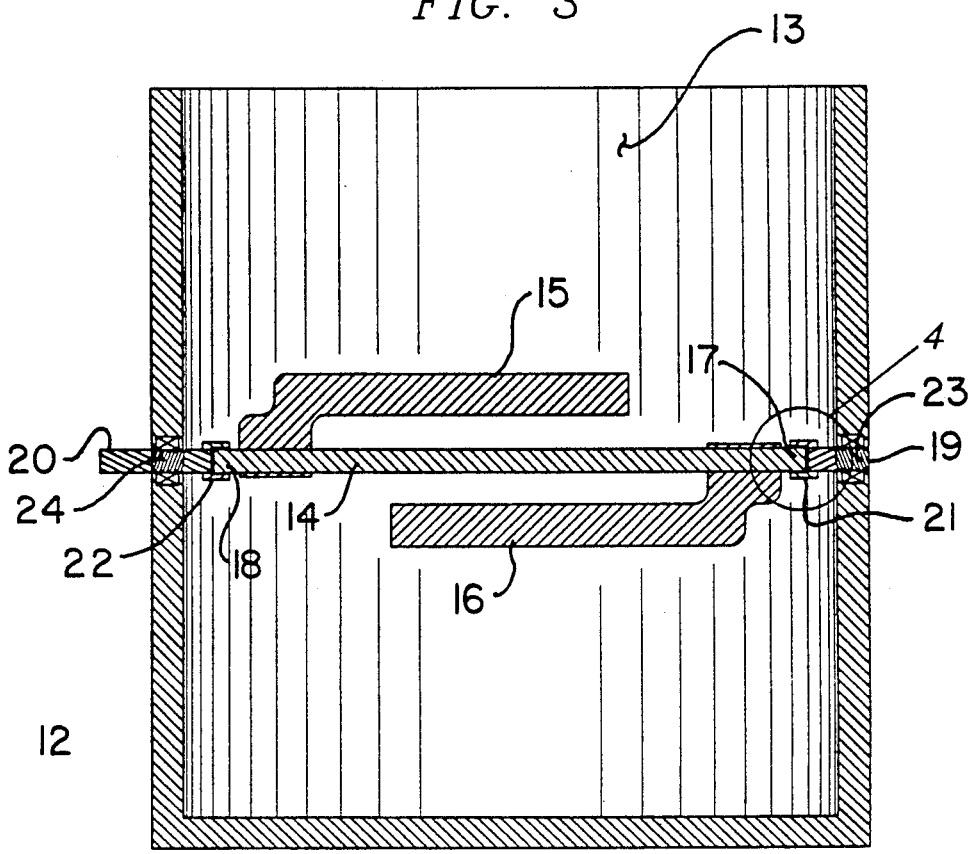
FIG. 3 is an orthographic cross-sectional illustration of the invention.
Figure 4:
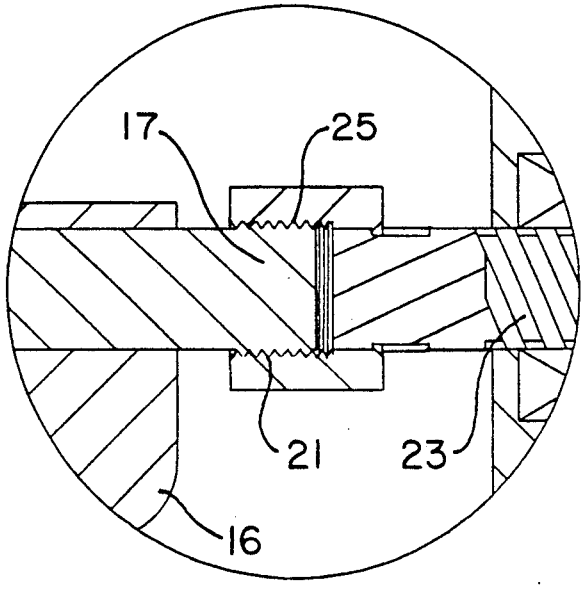
FIG. 4 is an enlarged orthographic view of section 4 as set forth in FIG. 3.

More specifically, the mixer apparatus 10 of the instant invention essentially comprises a container 11, having a continuous side wall 12 surrounding a container cavity 13. A rigid first shaft 14 is diametrically directed through the container side wall 12, having respective first and second mixing blades 15 and 16 mounted in a spaced relationship relative to the first shaft 14 and projecting on diametrically opposed sides of the first shaft in a parallel relationship relative to the first shaft 14, as indicated in FIG. 2 for example. The first shaft 14 is arranged to include a first shaft first end 17 having right hand thread, with a first shaft second end 18 having left hand thread, with the respective right and left hand thread portions of the first and second ends 17 and 18 respectively directed into respective first and second coupling sleeves 21 and 22 respectively. The first and second coupling sleeves 21 and 22 are arranged to include a spline interconnection relative to a second end third shaft 19 and 20 that are coaxially aligned relative to the first shaft 14 and extend from the respective first and second ends 17 and 18 to the first shaft in rotative mounting relative to the container side wall 12. A second shaft right hand thread 23 extends from the side wall 12 into the container cavity 13 along the second shaft 19, with a third shaft left hand thread 24 extending from the side wall 12 into the container cavity 11 to thereby direct fluid that may be present within the container cavity 13 during a mixing procedure preventing such fluid from being directed through the container wall and the bearing mount of the second and third shafts 19 and 20 within the container side wall 12. Further as indicated, the first shaft right hand thread is indicated by the numeral 25, with the first shaft left hand thread indicated by the numeral 26 in the FIGS. 2 and 4 for example.

Figure 5:
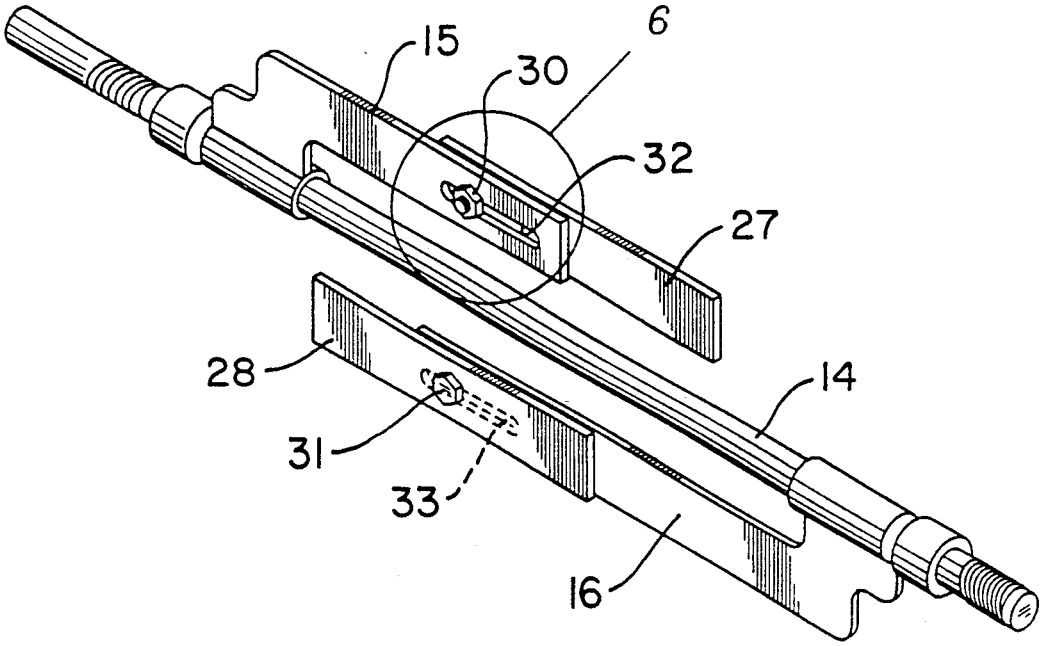
FIG. 5 is an isometric illustration of a modified blade structure employed by the invention.
Figure 6:
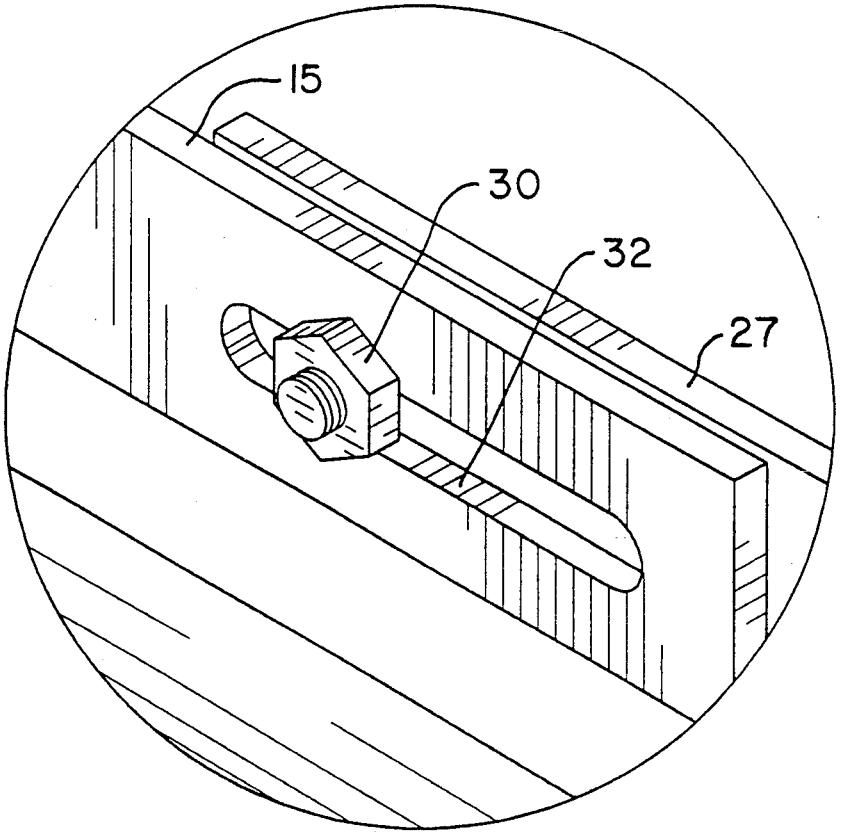
FIG. 6 is an isometric enlarged illustration of section 6 as set forth in FIG. 5.

The FIGS. 5 and 6 indicates the use of third and fourth blades 27 and 28 slidably mounted relative to the first and second blades 15 and 16, with the first and second blades including first and second slots 32 and 33 having respective first and second fasteners 30 and 31 to secure the third and fourth blades in an adjustable relationship relative to the first and second blades.

Figure 7:
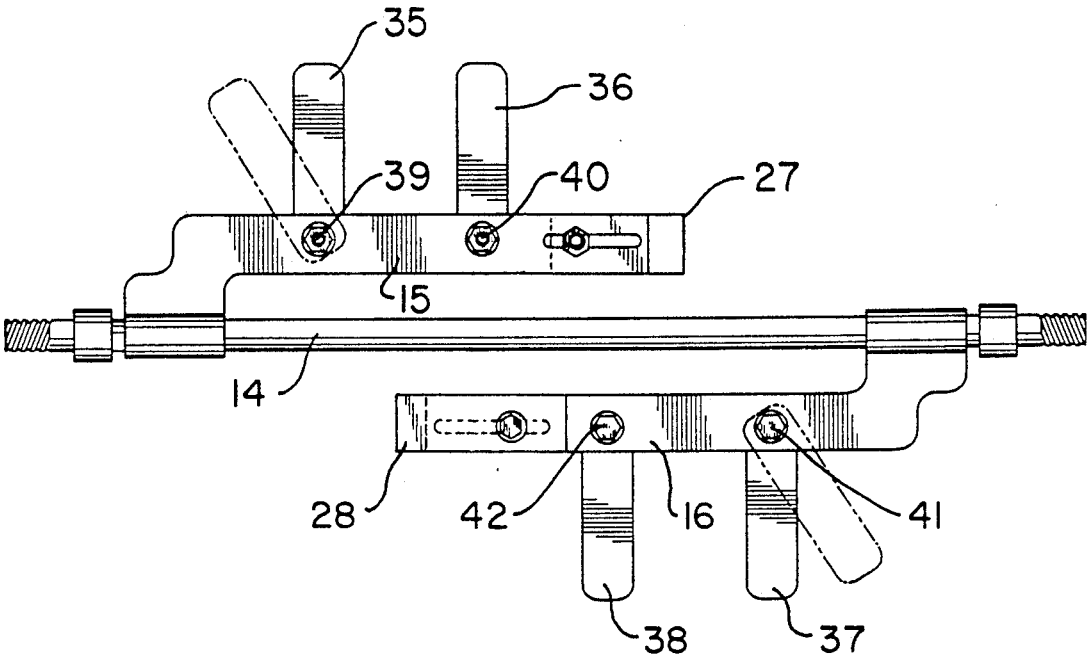
FIG. 7 is an orthographic view of a further modified blade structure employed by the invention.

The FIG. 7 further includes seventh and eighth blades 37 and 38 respectively, having seventh and eighth pivot axles 41 and 42 mounting the seventh and eighth plates pivotally relative to the second blade 16, with fifth and sixth blades 35 and 36 having fifth and sixth blade pivot axles 39 and 40 pivotally mounting the respective fifth and sixth blades 35 and 36 to the first blade 15 in addition to the third blade structure 27.

The additional blade structure enhances the mixing and agitation of components within the container cavity 13 for optional employment. It should be noted that the fifth through eighth blades are freely pivotally mounted in an unfixed relationship to permit the blades to adjust within the cavity 13 during a mixing procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mixer apparatus, comprising, a container, the container including a continuous side wall and a container cavity, with the side wall in surrounding relationship relative to the container cavity, and a rigid first shaft positioned within the container cavity diametrically aligned with the container side wall, with the rigid first shaft having a first mixing blade and a second mixing blade fixedly mounted to the first shaft in a spaced relationship, with the first mixing blade and the second mixing blade extending in a parallel relationship in adjacency to the first shaft, with the first mixing blade and the second mixing blade arranged in a substantially coplanar relationship relative to one another, and the first shaft includes a first shaft first end having a right hand thread, and a first shaft second end having a left hand thread, and a second shaft mounted in a coaxially aligned relationship relative to the first shaft first end, and a third shaft mounted coaxially in relationship to the first shaft second end, with the second shaft having a second shaft collar threadedly receiving the first shaft first end, the third shaft having a third shaft collar threadedly receiving the first shaft second end, with the second shaft collar arranged in a sliding relationship relative to the second shaft and the third shaft collar arranged in a sliding relationship relative to the third shaft, and the second shaft includes a right hand thread extending from the container side wall, the third shaft includes a left hand thread extending from the container side wall, with the third shaft projecting through the container side wall permitting rotation simultaneously of the third shaft, the second shaft, and the first shaft, and the first blade includes a first blade slot, the second blade includes a second blade slot, and a third blade mounted to the first blade, including a first fastener directed through the third blade and the first blade slot, and a fourth blade, the fourth blade including a fourth blade fastener directed through the second blade slot adjustably securing the fourth blade to the second blade.

2. An apparatus as set forth in claim 1 including a fifth blade having a fifth blade pivot axle, and a sixth blade having a sixth blade pivot axle, with the fifth blade pivot axle and the sixth blade pivot axle freely pivotal and mounted to the first blade, and a seventh blade having a seventh blade pivot axle and an eighth blade having an eighth blade pivot axle, wherein the seventh blade pivot axle and the eighth blade pivot axle are pivotally mounted to the second blade.

* * * * *